United States Patent [19]

Easter et al.

[11] 4,091,969

[45] May 30, 1978

[54] CONTAINER FILLING MACHINE WITH ADJUSTABLE DISPENSING CYLINDER

[75] Inventors: William M. Easter; Charles V. Wilhere; George M. Walker, all of Pittsburgh, Pa.

[73] Assignee: Horix Manufacturing Company, McKees Rocks, Pa.

[21] Appl. No.: 711,495

[22] Filed: Aug. 4, 1976

[51] Int. Cl.[2] ..... G01F 11/06

[52] U.S. Cl. ..... 222/309; 92/13.4

[58] Field of Search ..... 141/144–152, 141/298, 299, 18–27, 250–284; 92/13.4, 13.41, 13.6, 98 D; 222/309, 335; 138/30, 31

[56] References Cited

U.S. PATENT DOCUMENTS

| | | | |
|---|---|---|---|
| 2,761,605 | 9/1956 | Pahl et al. | 222/309 |
| 3,144,177 | 8/1964 | Cookson | 222/309 |
| 3,162,336 | 12/1964 | Erickson | 222/309 |
| 3,762,280 | 10/1973 | Kreuter et al. | 92/98 D |
| 3,881,360 | 5/1975 | Jurado | 222/309 |
| 3,945,302 | 3/1976 | Downs | 92/13.41 |

*Primary Examiner*—Houston S. Bell

*Attorney, Agent, or Firm*—Brown, Murray, Flick & Peckham

[57] ABSTRACT

The upper edge of a cup-shape flexible diaphragm in the lower part of a vertical dispensing cylinder is sealed to the side of the cylinder, with the bottom of the diaphragm engageable with the bottom of the cylinder around an inlet and outlet port to close it. The bottom wall of the diaphragm may have a central thickened portion for engaging the bottom wall of the cylinder, with the rest of the diaphragm bottom spaced from the cylinder bottom wall. Engaging the side wall of the cylinder above the diaphragm is a piston having a lower portion filling the diaphragm cup and attached to its bottom wall. The diaphragm and piston are movable upwardly in the cylinder by liquid product forced up through the cylinder port, and the upper part of the cylinder has an inlet for air to move the piston and diaphragm downwardly to expel liquid product from the cylinder. A vertical rod mounted in the top of the cylinder and extending down into it and also above it has a lower end engageable by the upwardly-moving piston, the rod being adjustably vertically so that the distance the piston can rise in the cylinder is adjustable.

9 Claims, 3 Drawing Figures

CONTAINER FILLING MACHINE WITH ADJUSTABLE DISPENSING CYLINDER

In U.S. Pat. No. 3,804,135 a container-filling machine is disclosed that is provided with adjustable-volume dispensing cylinders for the liquid product with which the machine fills containers. Each of these cylinders is provided in its lower portion with a cup-shape flexible diaphragm secured to a piston extending up into a fluid pressure cylinder that is adjustable up and down in the dispensing cylinder. With the piston in its lower position, in which the diaphragm engages the bottom of the dispensing cylinder, liquid product is forced out of the supply tank of the machine and up into the bottom of the cylinder, which forces the diaphragm and piston upwardly until the latter can move no farther. Then the tank valve is closed and the valve to the container-filling nozzle is opened and the piston is moved downwardly by air pressure to cause the diaphragm to force the liquid product out of the dispensing cylinder and into a container. The patented machine operates very satisfactorily, but it will be seen that both a dispensing cylinder and a fluid pressure cylinder are required at each filling station. Also, the volume of the dispensing cylinder is adjusted principally by a chain and sprocket arrangement operated by a hand wheel.

It is among the objects of the present invention to provide in a pressure-fill container-filling machine a dispensing cylinder which also serves as a fluid pressure cylinder, which has simple means for quick manual adjustment of the liquid product capacity of the cylinder, which has improved means for centering and attaching the diaphragm to its actuating piston, and which effectively seals the outlet of the dispensing chamber.

The preferred embodiment of the invention is illustrated in the accompanying drawings, in which FIG. 1 is a fragmentary horizontal section through the filling machine;

Figure 1:
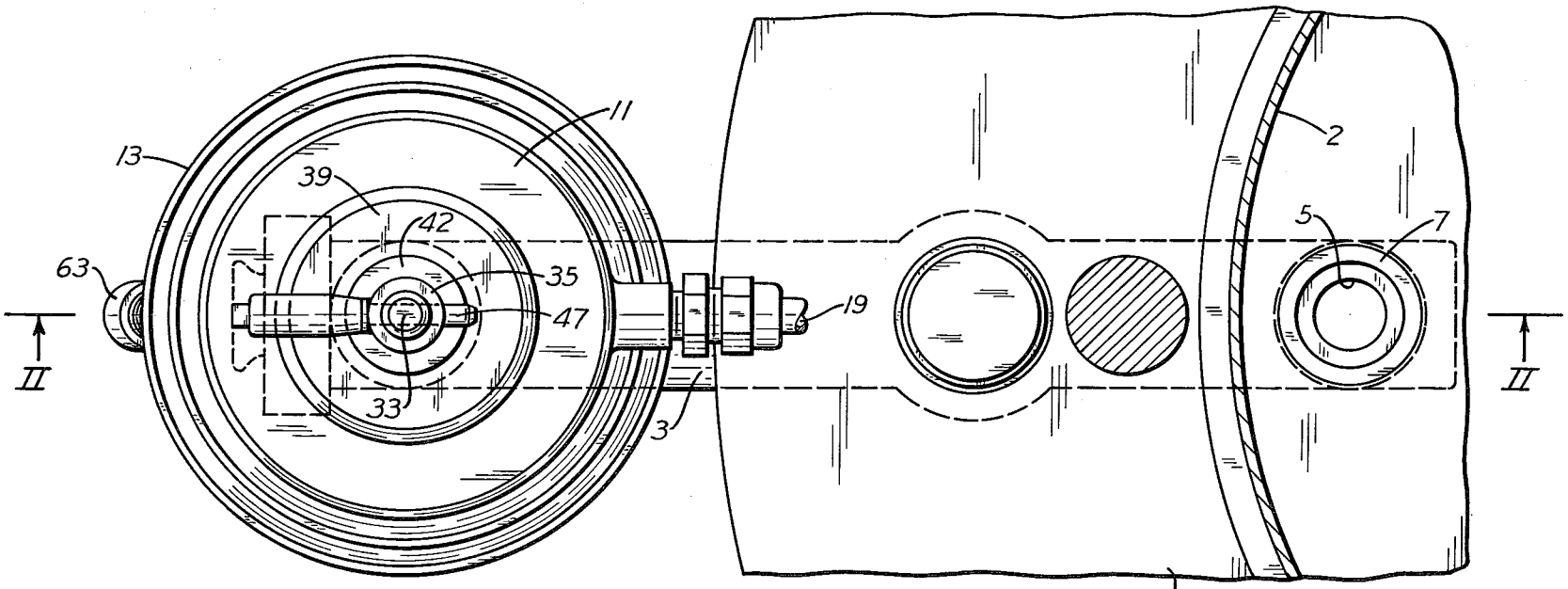

Referring to the drawings, a circular table 1 of a container-filling machine is rotatably mounted on a vertical axis and is driven continuously by conventional means not shown. Mounted on the table is a supply tank 2 for the liquid product with which containers are to be filled. The top of the tank is sealed, except for an opening that is connected by a hose (not shown) to suitable apparatus for maintaining pressure on the liquid product in the tank. The rotating table supports a plurality of horizontal conduit arms 3, only on of which is shown, extending radially away from the tank at circumferentially spaced intervals. Each rigid arm is provided with a longitudinal passage 4, the inner end of which opens into the lower end of a vertical passage 5 extending up through a boss 6 on the inner end of the arm. The boss is connected to a neck 7 extending down from an outlet in the bottom of the tank. The outer end of arm passage 5 opens into the lower end of a vertical passage 8 extending up through a boss 9 on the outer end of the arm. Rigidly mounted on this boss is the lower end of a neck 10 extending downwardly from around an inlet-outlet port in the lower end of a vertical dispensing cylinder 11, which is a volumetric measuring device for the liquid product.

This cylinder has upper and lower sections clamped together by an encircling band 13, with the edge of a flexible diaphragm 14 clamped between the two sections. The diaphragm is cup-shape when in its normal shape shown in dotted lines in FIG. 2, and divides the cylinder into upper and lower chambers, the lower chamber being for a liquid product. For economy of manufacture, the inner diameter of the cylinder preferably is uniform substantially from end to end. In the chamber above the diaphragm there is a long piston 15 that slides against the wall of the chamber. For best results, most of the piston is spaced slightly from the cylinder wall, but its upper end is enlarged to form an integral collar 16 that engages that wall and is provided with a circumferential groove in which a sealing ring 17 is mounted. To maintain the lower end of the piston concentric with the cylinder, the piston is provided some distance below its upper end with an encircling collar 18 that slides against the cylinder wall. Below this collar the piston preferably tapers downwardly slightly and extends down into the cup-shape diaphragm. The piston fits in the diaphragm snugly and the lower end of the piston engages flat against the bottom wall of the diaphragm.

With the piston and diaphragm in their lower position, the diaphragm engages the bottom of the cylinder and closes the port beneath it. The upper part of the diaphragm extends a short distance above the joint between the two sections of the cylinder and is doubled upon itself. The rest of the side wall of the diaphragm is spaced a short distance from the cylinder wall to provide an annular space between them, in which the side wall of the diaphragm can roll as the diaphragm is moved upwardly from its lowest position. Near the top of the cylinder there is an inlet 19 for air under pressure to drive the piston down.

Figure 3:
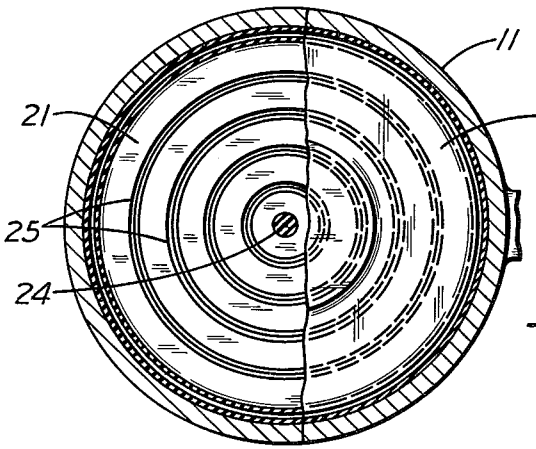
FIG. 3 is an enlarged horizontal section taken on the line III—III of FIG. 2.
Figure 2:
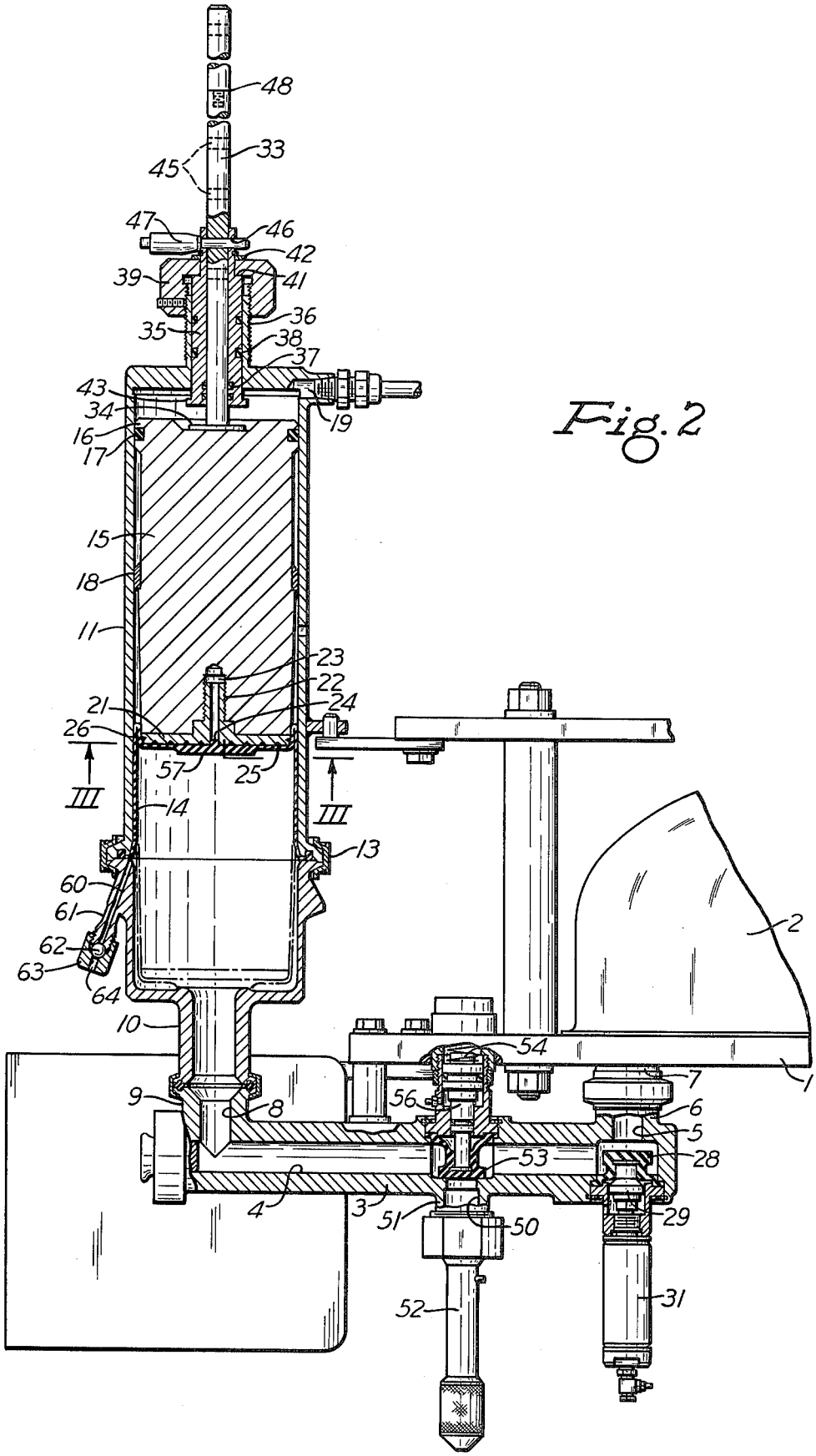
FIG. 2 is a reduced vertical section taken on the line II—II of FIG. 1.

The lower end of the piston is formed from a circular disc 21 provided with a threaded stem 22 that extends up into a central opening 23 in the piston body. At the center of this disc there is an opening, in which a small plug 24 at the center of the diaphragm fits. The bottom wall of the diaphragm is bonded to the bottom and side of the disc by a suitable adhesive. It is very important that the diaphragm be precisely centered on the disc, and the plug and disc opening just mentioned are a great help in this centering during the bonding process. To ensure a good bond between the diaphragm and disc, the bottom of the disc is provided with grooves 25, preferably concentric with one another as shown in FIG. 3, and the edge of the diaphragm is provided with one or more annular grooves 26 (FIG. 2). These grooves not only increase the surface area of the disc engaged by the adhesive, but they also provide a mechanical lock between the disc and the bonding adhesive.

The outlet from the supply tank is closed by a valve 28 at the lower end of passage 6. This valve can be raised and lowered in any suitable manner, such as by a plunger 29 in a fluid pressure cylinder 31. The valve normally is held closed by air pressure delivered to the lower end of this cylinder, but when this pressure is reduced sufficiently and the upper end of the dispensing cylinder has been connected with the atmosphere through inlet 19, the air pressure above the liquid in the tank will force the liquid down through passage 5 and past the valve and out through arm 3 and up into the lower end of the dispensing cylinder, where the liquid will push the diaphragm upwardly until the top of the piston engages a stop. In this way the dispensing chamber below the diaphragm is filled with liquid product, the quantity depending upon how far the diaphragm can move upwardly.

Upward movement of the piston in the cylinder is limited by a vertically adjustable stop. In accordance with this invention, the stop takes the form of a vertical rod 33 that may have a foot 34 on its lower end. The rod extends up through a sleeve 35 that can be moved up and down in a central opening in the top of the cylinder. Extending upwardly from this opening is a threaded flange 36 that encircles and engages the sleeve. Sealing rings 37 and 38 in grooves in the sleeve engage the rod and the inside of the threaded flange. Near its upper end the diameter of the sleeve is reduced and this reduced portion extends up through a nut 39 that is threaded on the flange. The nut is held against a shoulder 41 on the sleeve by means of a washer 42 encircling the sleeve above the nut and locked in place. Consequently, when the nut is turned, the sleeve will be moved up or down in the upper end of the cylinder. The lower end of the sleeve is encircled by a flange 43 that limits upward movement of the sleeve.

Rod 33 is provided at vertically spaced intervals with passages 45 through it, and the portion of sleeve 35 above nut 39 is provided with openings 46, with which any one of the passages can be aligned. With a passage and the openings in alignment, a retaining pin 47 is inserted to prevent vertical movement of the rod in the sleeve. It will be seen that the farther the rod extends down into the cylinder, the less the capacity that the dispensing chamber will have. The rod can be marked beside its passages with figures indicating different dispensing chamber volumes. For finer adjustments, the nut can be turned on the sleeve, which will cause both the sleeve and the rod to move up or down together. When the rod is in its uppermost position, it may project an undesirable distance above the cylinder, so it is preferred to make the rod in at least two sections that are screwed together, as indicated at joint 48. If it is felt that for a given adjustment the rod extends too far above the cylinder, its upper section can be unscrewed and laid aside.

In order to fill a container from the dispensing cylinder, the conduit arm 4 has an outlet opening 50 in its bottom between the tank valve and the dispensing cylinder. Extending downwardly from this opening is a neck 51, to the lower end of which a container filling tube 52 is attached for insertion in a container in the usual manner. While the dispensing chamber is being filled from the tank, outlet 50 is closed by a valve 53 forced against its seat by a coil spring 54. This valve is of such shape that it does not block the passage through the arm while the dispensing chamber is being filled.

After the dispensing chamber has been filled as previously described, the tank valve is closed and the product valve 53 is opened by air pressure beneath a piston 56 attached to it. Then air pressure is supplied to the upper end of the dispensing cylinder to force its piston 15 and the diaphragm 14 down in order to discharge liquid from the dispensing chamber down through the filling tube 52 and into a container in which the tube is inserted. If all of the dispensing cylinders of the machine have been adjusted properly, all of them will deliver exactly the same amount of product to the containers. It will be understood that as the table 1 and arms 3 revolve, the dispensing chambers are filled and emptied in succession.

To provide a good seal for the inlet-outlet port in the bottom of cylinder 11, it is preferred that the central portion of the bottom wall of the diaphragm be thickened to form a circular pad 57 that will engage a narrow area of the bottom of the cylinder around the inlet-outlet port. The rest of the bottom of the diaphragm is spaced from the bottom of the cylinder, so the pressure of the diaphragm against it is concentrated in a small area.

The side of the lower section of the dispensing cylinder is provided with a passage 60 and a tubular projection 61 provided at its outer end with a hemispherical recess containing a ball valve 62 that is held in place by a cap 63 screwed onto the outer end of the projection. The cap is provided with a passage 64 extending inwardly to the ball. Before piston 15 is lowered the first time, the cap is loosened so that air trapped in the dispensing chamber can be bled out through the passages 60 and 64. Of course, most of the air will be forced out through neck 10, but when the diaphragm is in its lowest position, in which the outlet from the dispensing cylinder is closed, there still will be air trapped in the folded-over upper end of the diaphragm. Such trapped air would interfere with accuracy of product volume delivered to containers, so it is highly desirable to let this trapped air escape from the cylinder. This it does when the piston is lowered while valve 62 is open. Then the cap is screwed up tight to cause the ball to close passage 60.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. In a pressure-fill container filling machine, a vertical dispensing cylinder with an inlet and outlet port in its lower end for liquid product, a cup-shape flexible diaphragm in the lower part of the cylinder, means sealing the edge of the diaphragm to the side of the cylinder, the bottom of the diaphragm being engageable with the bottom of the cylinder around said port to close it, a piston in the cylinder, the piston having an upper portion always engaging the side wall of the cylinder above the diaphragm to center the piston in the cylinder and having a lower portion spaced from the side wall of the cylinder to house the diaphragm during flexing of the diaphragm and filling the cup-shape diaphragm when the piston is in its lowest position, means attaching the lower end of the piston to the bottom wall of the diaphragm, the diaphragm and piston being movable upwardly in the cylinder by liquid product forced up through said port, the upper part of the cylinder being provided with an inlet for air under pressure to move the piston and diaphragm downwardly to expel liquid product from the cylinder through said port, a vertical rod mounted in the top of the cylinder and extending down into it and also above it and having a lower end engageable by the upwardly moving piston, and means for adjusting the rod vertically relative to the cylinder, whereby the distance the piston can rise in the cylinder is adjustable.

2. In a pressure-fill container filling machine according to claim 1, the top of said cylinder being provided with a vertical opening receiving said rod and encircled by an upwardly extending externally threaded flange, a sleeve slidably disposed in said opening and flange and encircling said rod in sliding engagement therewith, a nut screwed on the upper end of said flange for vertical adjustment thereon, means attaching said sleeve to the nut for vertical adjustment therewith, the sleeve extending above the nut, and a removable pin extending through aligned holes in the upper end of said sleeve and through any one of a plurality of vertically spaced holes in said rod aligned with said sleeve holes, said pin fitting the aligned holes to hold said rod in selected fixed vertical positions to the sleeve.

3. In a pressure-fill container filling machine according to claim 1, the side of the cylinder below said sealing means being provided with an air vent, and means for closing the vent after the piston has been lowered the first time.

4. In a pressure-fill container filling machine according to claim 1, the bottom of said diaphragm having a central thickened portion forming a pad engaging the bottom wall of the cylinder around said port when the piston is in its lowest position, said pad spacing the rest of the diaphragm bottom from said cylinder bottom wall.

5. In a pressure-fill container filling machine, a vertical dispensing cylinder with an inlet and outlet port in its lower end for liquid product, a cup-shape flexible diaphragm in the lower part of the cylinder, means sealing the edge of the diaphragm to the side of the cylinder, the bottom of the diaphragm being engageable with the bottom of the cylinder around said port to close it, a piston in the cylinder having a head filling the cup-shape diaphragm when the piston is in its lowest position, and means attaching the lower end of the piston head to the bottom wall of the diaphragm, the piston always extending above the diaphragm and having an upper portion above the diaphragm always engaging the side wall of the cylinder to center the piston therein and having a lower portion spaced from the side wall of the cylinder to house the diaphragm during flexing of the diaphragm, the bottom of the diaphragm having a central thickened portion forming a pad engaging the bottom wall of the cylinder around said port when the piston is in its lowest position, said pad spacing the rest of the diaphragm bottom from said cylinder bottom wall, the diaphragm and piston being movable upwardly in the cylinder by liquid forced up through said port, and the piston and diaphragm being movable downwardly to expel liquid product from the cylinder through said port.

6. In a pressure-fill container filling machine according to claim 5, said piston head having a central opening in its bottom, and the bottom wall of the diaphragm having a central projection fitting in said opening to center the piston head in said diaphragm before attachment thereto.

7. In a pressure-fill container filling machine according to claim 6, said piston including a body and a disc connected to its lower end provided with said central opening.

8. In a pressure-fill container filling machine according to claim 7, the side of said disc being provided with an annular adhesive-receiving groove and the bottom of the disc having adhesive-receiving grooves in it, whereby to secure the disc to said diaphragm.

9. In a pressure-fill container filling machine according to claim 1, said cylinder-engaging area of the piston being formed from vertically spaced piston collars, the lowest of said collars always being located above said diaphragm.

* * * * *